324-77.
2-10-76 XR 3,937,942

United States Patent [19]
Bromley et al.

[11] 3,937,942
[45] Feb. 10, 1976

[54] MULTI-CHANNEL OPTICAL CORRELATION SYSTEM

[75] Inventors: Keith Bromley, San Diego; Michael A. Monahan, Poway; Richard P. Bocker, San Diego, all of Calif.

[73] Assignee: The United States of America as represented by the Secretary of the Navy, Washington, D.C.

[22] Filed: July 1, 1974

[21] Appl. No.: 484,832

[52] U.S. Cl. ..... 235/181; 324/77 G; 324/77 K; 357/24

[51] Int. Cl.[2] ..... G06G 7/19; G06G 9/00

[58] Field of Search..... 235/181; 324/77 G, 77 K; 307/221 C, 221 D; 357/24

[56] References Cited

UNITED STATES PATENTS

| | | | |
|---|---|---|---|
| 3,789,240 | 1/1974 | Weimer | 307/221 D |
| 3,801,884 | 4/1974 | Sequin | 357/24 |
| 3,806,729 | 4/1974 | Caywood | 307/221 C |
| 3,811,055 | 5/1974 | Weimer | 307/221 D |

OTHER PUBLICATIONS

Amelio: Charge-Coupled Devices, Scientific American Vol. 230, No. 2 Feb. 1974 pp. 22–31.

*Primary Examiner*—Felix D. Gruber
*Attorney, Agent, or Firm*—R. S. Sciascia; G. J. Rubens; J. W. McLaren

[57] ABSTRACT

A multi-channel optical correlation system employs a light source to illuminate a mask having a plurality of linearly disposed channels, each of which has recorded information defined by variations in opacity along its linear length. The light source is modulated as a function of an unknown input signal. A multiple element charge coupled device having its elements arrayed in linearly disposed groups along axes parallel to the linearly disposed channels of the illuminated mask is positioned to receive the light energy transmitted by the illuminated mask for developing a charge within each such element commensurate with the photo energy received at its discrete position. A source of clock signals is periodically applied to the charge coupled device for cumulatively shifting the charges developed by each of the linearly disposed groups of discrete elements and a suitable means responsive to the resultant cumulative charge outputs of such groups indicates the group having maximum amplitude of cumulative charge thereby identifying the unknown input signal with the recorded information contained on the particular channel associated with that group.

5 Claims, 8 Drawing Figures

MULTI-CHANNEL OPTICAL CORRELATION SYSTEM

CROSS-REFERENCE TO RELATED APPLICATION

The subject matter of the present invention is related generally to pending U.S. patent application Ser. No. 234,749, filed Mar. 15, 1972 now U.S. Pat. No. 3,816,735 in the name of the inventor herein.

BACKGROUND OF THE INVENTION

Within present day data processing and signal identification technologies there are many requirements for the classification of an unknown input signal. Typically, such an unknown input signal may be represented in various forms of energy including sound, electromagnetic, visible light, etc. In many prior art systems it was customary to convert such an unknown input signal from its original form of energy to a commensurate electrical signal to render it compatible with electronic data processing and computation techniques and equipments. The capabilities of such electronic equipment in both digital and analog form were thus rendered available to perform the task of classifying an unknown incoming signal, such as, for example, by electronic comparison with a stored library of known reference signals and signal combinations.

Unfortunately, however, electronic data processing computation techniques suffer from the disadvantage that they are basically one-dimensional in nature in the sense that an electron flow has but a single dimension; therefore, the comparisons between an unknown input signal and a stored library of known reference signals and signal combinations must be accomplished sequentially.

Despite the high speed of modern data processing and data computation such a process which is inherently limited to a "one-dimensional" sequential operation can take a considerable length of time to accomplish, with the result that the process may not truly be a "real time" procedure. That is to say, that the comparison process is not completed before another unknown input signal has arrived for identification by subsequent comparison. Of course, those skilled in the pertinent arts will be fully aware that an electronic data processing system can be arranged to operate in a plurality of parallel equipments, but such multiple expansion is costly, adds undesirable complexity, and involves an almost prohibitive number of component elements where a large plurality of parallel equipments are required.

Also known in the prior art are optical techniques for performing correlation processes to identify unknown incoming signals but many of such optical techniques depend upon a special coherent source of light such as a laser which adds to the complexity and maintenance of stringent operational performance as well as contributing undesirably to the overall size of the equipment. Additionally, many of the equipments employed to carry out such optical techniques for performing correlation processes involve moving parts in the form of elements such as oscillating reflective surfaces or revolving mirrors, for example, for performing optical sweeping functions. Such moving elements undesirably add to the problem of synchronism of operation of the equipments in which they are employed and also inherently involve the possibility of a lessened reliability due to unavoidable factors affecting moving parts such as wear, lubrication, vibration, shock damage, etc.

Accordingly, there is a need for a "real-time" multichannel optical correlation system that will classify an unknown incoming signal rapidly with a high degree of reliability and which can be performed by equipment that is relatively simple, compact in size, has a minimum of stringent maintenance requirements, is devoid of any mechanically moving parts, and additionally can readily accommodate a large plurality of stored reference signals for simultaneous processing.

SUMMARY OF THE INVENTION

The concept of the present invention obviates many of the disadvantages of prior art systems and also provides very desirable advantages which inher in its operation. Because it is an optical system employing optical techniques, the method and concept of the present invention is conducive to the simultaneous processing of an unknown input signal to determine its correlation with one or more of a great number of stored known reference signals which may number as many as a thousand channels or more, for instance. Most importantly, the concept of the present invention provides a technique and system which is inherently and entirely electro-optic in nature so that no moving parts or mechanical elements are involved in any way whatever.

Moreover, the concept and method of the present invention affords the added advantage that it is readily adaptable to accommodate a high density of data points per channel for a great number of such channels. For instance, the present invention may readily embody a thousand channels of recorded reference signal information, each channel having the capability of recording and representing one thousand or more data points. Though in many instances the data points within a channel may be in a simple binary form, the method and concept of the present invention is not so limited but is capable of accommodating any bounded, one-dimensional function in either analog or digital form.

The concept of the present invention contemplates a method and means by which a library of reference signals is recorded on a plurality of adjacent linearly disposed channels. Such a recording may, in one of its simplest forms, comprise a mask of photographic film or plate in which the reference information is linearly disposed along a plurality of channels and defined by variations in opacity along the linear length of each channel.

A light source is positioned to illuminate the mask so that the non-opaque or less opaque portions of the mask permit light to pass therethrough as a function of its opacity at each discrete position, while the opaque portions of the mask substantially block the passage of light. A most important feature of the concept of the present invention is that the light source need not be any particular type of light such as monochromatic, non-coherent, coherent, or laser light but may be any light source which provides sufficient intensity to meet the design requirements of the system.

An appropriate means is arranged to temporally modulate the intensity of the light source as a function of the unknown incoming input signal. A multiple-element charge coupled device having its elements arrayed in linearly disposed groups along axes parallel to the previously described linearly disposed channels is positioned to receive the light energy transmitted by the illuminated mask for developing a charge within each such element commensurate with the photo energy received at its particular discrete position.

A source of clock signals is applied to the charge coupled device for cumulatively shifting charges developed by each of the linearly disposed groups and a suitable means responsive to the cumulative charge outputs of the groups is provided for indicating that particular group having the maximum amplitude of cumulatively shifted charges thus indicating that the channel operatively associated with that group of elements of the charge coupled device is substantially correlated to and identified with the unknown incoming input signal.

Thus, it may be readily appreciated by those knowledgable and skilled in the pertinent arts that the concept of the present invention provides a system which, through the use of a multiple element charge coupled device, combines the functions of photo responsivity, simultaneous sweeping of multiple channels by cumulatively shifting charges, and the resultant integration of such cumulatively shifted charges, as well. Most importantly, in addition to the combination and simplification of such multiple functions, the concept of the present invention eliminates the necessity for the use of any moving parts or mechanical elements in its practice.

Because the method and concept of the present invention contemplates a system wherein an unknown input signal may be compared with a large plurality of stored known reference signals simultaneously, it is in effect a "two-dimensional" system which inherently is capable of great speed of operation providing "real time" results and a high degree of reliability as well, because it is wholly and entirely electro-optical in nature.

Accordingly, it is a primary object of the present invention to provide an improved high speed correlation system for identifying unknown input signals by simultaneous comparison with a large plurality of known stored reference data.

Another object of the present invention is to provide such capabilities in a wholly electro-optical system which is simple in concept and operation, compact in size, and inherently possesses a high degree of reliability because of the absence of moving parts or mechanical elements.

A further object of the present invention is to provide such a correlation system which, because of its concept, inherently combines a number of functional requirements such as photo responsivity, channel sweep, and integration in one single element.

Yet another object of the present invention is to provide such a high performance correlation system which does not require a highly specialized light source but is readily adaptable to the use of non-coherent light sources.

Another most important object of the present invention is to provide such a high performance correlation system which because of its concept is readily adapted to embody the advantageous use of integrated electro-optical components.

These and other features, objects, and advantages of the present invention will be better appreciated from an understanding of the operative principles of a preferred embodiment as described hereinafter and as illustrated in the accompanying drawings.

BRIEF DESCRIPTION OF THE DRAWINGS

In the drawings:

FIGS. 4*a*, 4*b*, 4*c*, 4*d*, and 4*e* are illustrations of the types of signals developed in the operation of the present invention.

DESCRIPTION OF THE PREFERRED EMBODIMENTS

The cross-correlation function between an input signal $f(t)$ and a reference signal $g(t)$ is given mathematically by $$C(\tau) = \int g(t)\, f(t-\tau)\, dt \qquad (1)$$

If both the input and reference signals are sampled signals then this equation becomes $$C_m = \sum_{n=1}^{N} g_n f_{n-m}$$

It can be shown that each horizontal channel of a charge coupled device array performs the above operations. Since there are a multiplicity of such channels and a multiplicity of reference signal channels on the mask a charge coupled device array can perform many such cross-correlation operations simultaneously. That is, the $j^{th}$ channel of the mask and the $j^{th}$ channel of a charge coupled device array give the output $$C_{j,m} = \sum_{n=1}^{N} g_{j,n} f_{n-m} \qquad (2)$$

Using an optical system to perform this multi-channel cross-correlation provides the advantages of (1) the transmission of light through an optical transparency provides an extremely fast analog multiplication rate, and (2) the two-dimensional nature of light wavefronts allows parallel processing capability, i.e., all the $C_j$'s are generated simultaneously. In the concept of the present invention the $g_j$'s form a library of J-reference signals and the $C_j$'s are the cross correlation values between the input data and the reference signals $g_j$.

Figure 1:
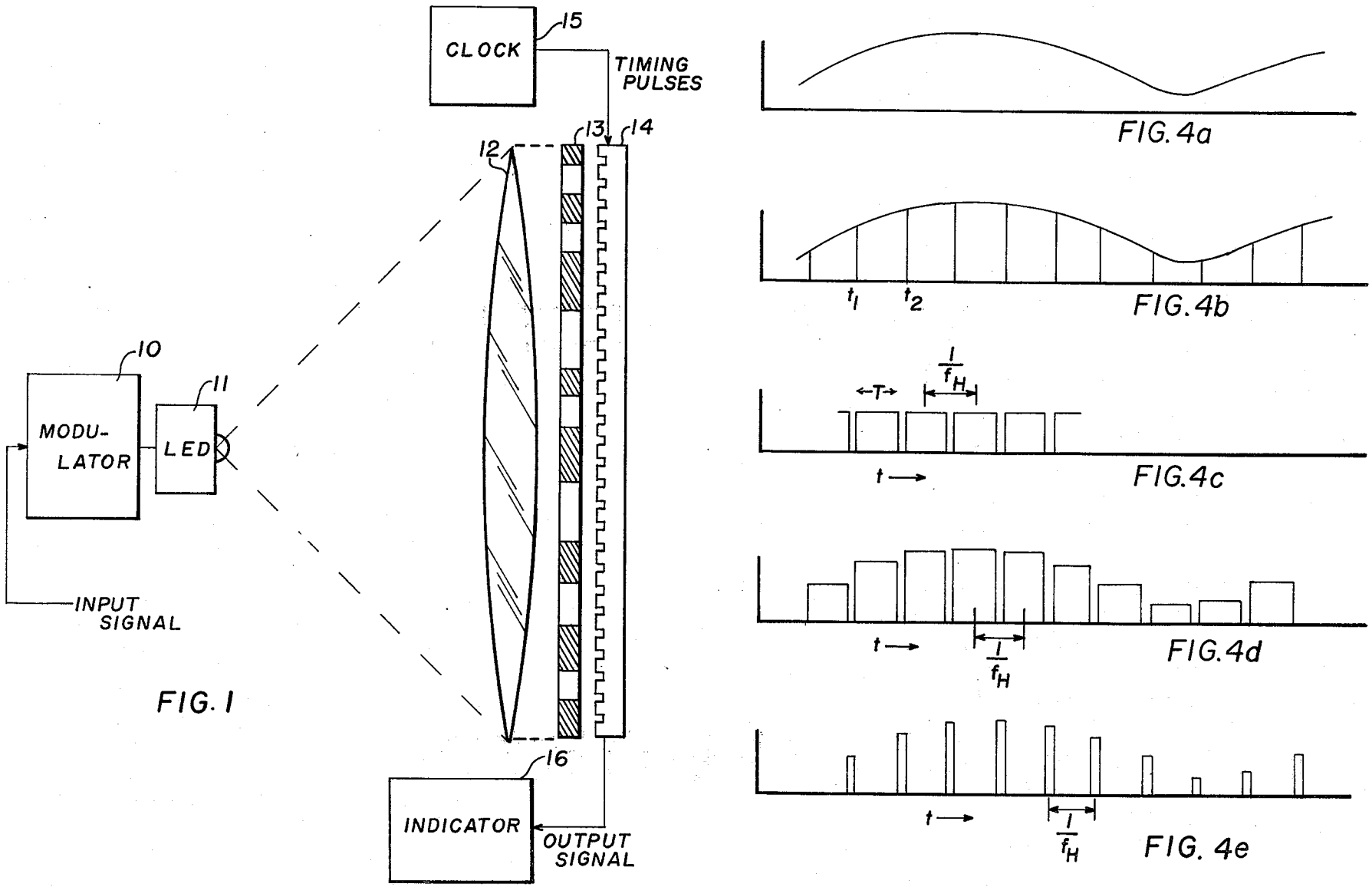
FIG. 1 is a top view schematic representation of an embodiment of the present invention.

In FIG. 1 an unknown incoming input signal is received by a modulator 10 which operates to temporally modulate the intensity of a suitable light source 11. The light source 11 may be incoherent light as provided by a suitable light emitting diode, for example. The diverging light energy emitted from the light source 11 can be passed through an optional condensing lens 12 to provide a plane of uniform light distribution. The light condensing lens 12, however, is not an absolutely essential element of the present invention in those combinations of elements embodying the present invention wherein the light source 11 itself provides a sufficiently uniform plane of light distribution. Also, with such a large-area light source, the light source, mask, and charge coupled device may be in physical contact (i.e., no space required between them) thus forming a laminate configuration.

Figure 2:
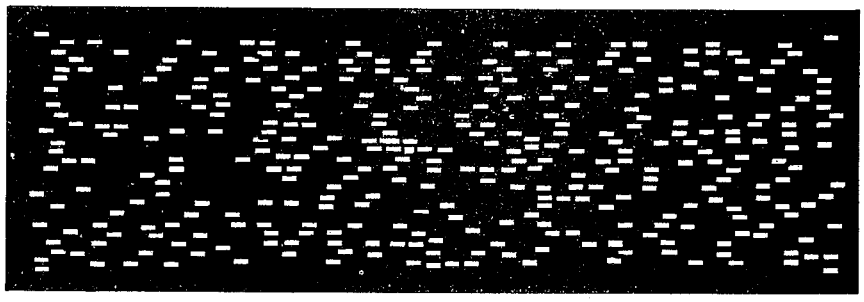
FIG. 2 is an illustration of a mask such as may be employed in the present invention having a plurality of linearly disposed channels each containing known recorded information defined by variations in the opacity at discrete positions along each channel.

A two-dimensional mask 13 is positioned to intercept the light energy which has been modulated in accordance with the unknown input signal. The mask 13 is of the type illustrated in FIG. 2 comprising a plurality of linearly disposed channels, each channel having recorded information which is defined by variations in opacity along its linear length. Such a mask may be suitably fabricated by photographic recording on film or photographic plate, for example.

Immediately adjacent to mask 13 a multiple element, charge coupled device is positioned to receive the light energy transmitted by the illuminated mask 13 and containing J-horizontal rows of N-detector elements each. These elements are arrayed and linearly disposed in groups along axes which are parallel to the linearly disposed channels of the mask so as to be capable of developing a charge within each said element commensurate with the photo energy received at its discrete position. It should be noted that for purposes of explanation and avoiding undue complexity the schematic illustration of FIG. 1 depicts only a single horizontal channel of the mask 13 and of the multiple element charge coupled device 14 in a schematic, cross-sectional manner. The spaced individual elements disposed on the charge coupled device 14 and facing the mask 13 schematically represent the photo-responsive discrete areas of the charge coupled device 14 which may take the form of a multiple element self-scanning image sensor such as the Fairchild CCD 201, which has 10,000 elements in a 100 × 100 disposition.

A clock 15 is provided to supply suitable timing pulses for implementing the scanning or sweeping functions within the groups of linearly disposed elements of the charge coupled device 14 so as to cause it to operate in the manner of a shift register for cumulatively shifting charges developed within each such linearly disposed group, generating a cumulative charge output for each such group indicative of its degree of correlation with the unknown incoming input signal. The outputs thus are connected to an indicator 16 which may be employed to visually indicate, record, or otherwise utilize the output of the charge coupled device 14. Such an indicator is not an absolute essential of the concept of the present invention however, and the output of the charge coupled device of the present invention may be used directly as desired for any one or more of a number of suitable purposes.

The operation of the embodiment of FIG. 1 may be explained by letting the time varying light intensity impinging upon the mask 13 be designated by $f_t$ where the subscript $t$ represents time. The position varying intensity transmittance across the $j^{th}$ channel of the mask is $g_{j,n}$ where the subscript $n$ denotes the increments of horizontal position along the channel. In the following discussion of the operational sequence of events, reference should be made to Table I which is representative of the values of electron charges stored in the $j^{th}$ horizontal channel as a function of time.

TABLE I

| | Channel Elements → | | | |
|---|---|---|---|---|
| Time | 1 → | 2 → | 3 | N → |
| $t_1$ | $f_1g_1$ | $f_1g_2$ | $f_1g_3$ | $f_1g_N$ |
| $t_2$ | $f_2g_1$ | $f_2g_2+f_1g_1$ | $f_2g_3+f_1g_2$ | $f_2g_N+f_1g_{N-1}$ |
| $t_3$ | $f_3g_1$ | $f_3g_2+f_2g_1$ | $f_3g_3+f_2g_2+f_1g_1$ | $f_3g_N+f_2g_{N-1}+f_3g_{N-2}$ |
| ⋮ | ⋮ | ⋮ | ⋮ | ⋮ |
| $t_N$ | $f_Ng_1$ | $f_Ng_2+f_{N-1}g_1$ | $f_Ng_3+f_{N-}+_{fN-2}g_1$ | $f_Ng_N+f_{N-1}g_{N-1}+\ldots+f_1g_1$ |

In the time sequence of events at time $t = 1$, the intensity illuminating the mask 13 is $f_1$. Immediately behind the $j^{th}$ channel of the mask the intensity values of $f_1g_{j1}$, $f_1g_{j2}, f_1g_{j3}, - - - f_1g_{jN}$ impinge upon the $j^{th}$ channel of the charge coupled device array. The photo responsive elements as shown on the left-hand face of the charged coupled device array 13 of FIG. 1 then convert the received intensity distribution to a commensurate charge distribution which is stored in the $j^{th}$ horizontal shift register channel within the CCD.

When a timing pulse is received by the charge coupled device array 14 from the clock 15, the electron charges in the J-channels are shifted by one increment to the position associated with the adjacent photo responsive element. Then the cycle starts over again; at time $t = 2$ the intensity illuminating the mask is $f_2$ and the intensity distribution emerging from the $j^{th}$ channel of the mask 13 is $f_2g_{j1}, f_2g_{j2}, f_2g_{j3}, - - - f_2g_{jN}$.

As before the photo responsive elements of the charge coupled device array 14 now convert the light energy intensity distribution to a commensurate charge distribution. The charge coupled device array 14 then adds the latter generated charges to those stored in the associated storage cells. Thus, the state of the $j^{th}$ channel may be represented as $f_2g_{j1}, f_2g_{j2}+f_1g_{j1}, f_2g_{j3}+f_1g_{j2}$ - - - , $f_2g_{jN}+f_1g_{jN-1}$ as shown for line $t_2$ for Table I.

Subsequent timing pulses cause charges to be shifted along the channels by a commensurate number of increments. During these shifts for each of the J-channels, the charges stored in the $N^{th}$ cell of the charge coupled device array emerges in a cumulative form as output data. The process of repetitively shifting the charges within each of the channels by one increment and then adding to them the new intensity distribution illuminating the photo responsive elements may be referred to as the "shift and add" property of charge coupled devices.

At the time $t = N$ the intensity distribution impinging on the $j^{th}$ channel of the charge coupled device array photo responsive elements is $f_Ng_{j1}, f_Ng_{j2}, f_Ng_{j2}, f_Ng_{j3}, - - -$ , $f_Ng_{jN}$ after the charge coupled device array has converted the received light energy intensity distribution to a commensurate electron charge distribution and it has been added to the previously stored charge distribution the $j^{th}$ channel of the charge coupled device array contains $f_Ng_{j1}, f_Ng_{j2}+f_{N-1}g_{j1}, - - -$ , $f_Ng_{jN}+f_{N-1}g_{jN-1}+ - - - +f_1g_{j1}$ as stated at line $t_N$ of Table I. When the timing pulse then shifts this last distribution by one increment, the cumulative charge is read out and this cumulative charge is in the desired form which may be expressed as $$C_j = \sum_{n=1}^{N} g_{jn}f_n$$

Figure 3:
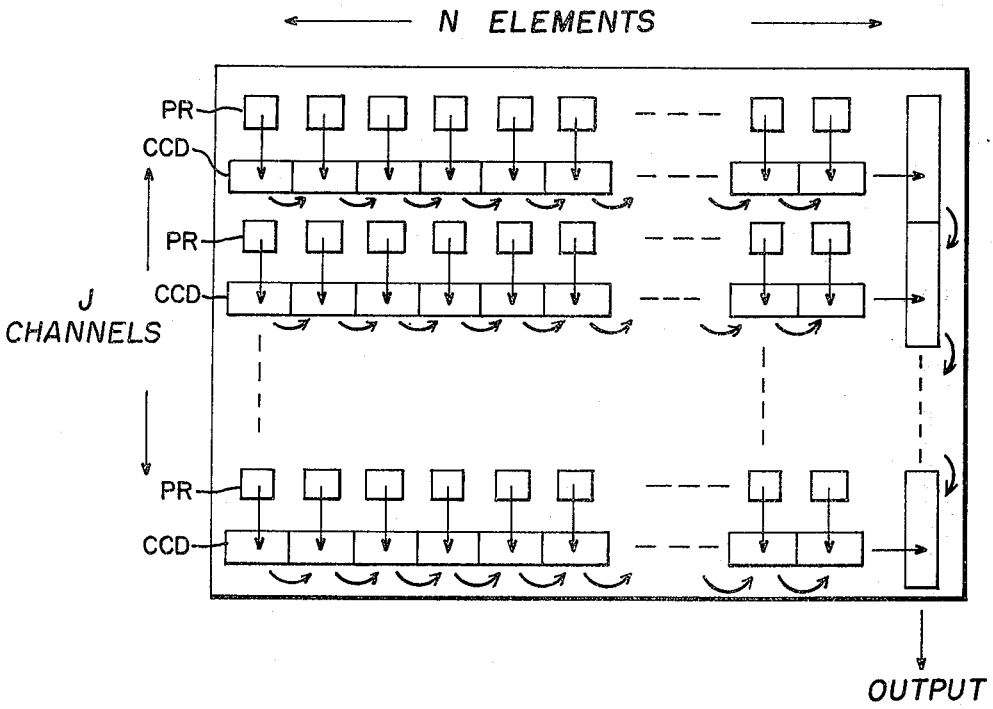
FIG. 3 is a schematic representation of a charge coupled device such as may be employed in the present invention.

FIG. 3 is a diagrammatic illustration in which J-channels of linearly disposed groups, each group including photo-responsive elements represented by the rectangles designated PR, are schematically shown immediately above respectively associated charged coupled elements designated CCD. From Table I and the foregoing description, together with the illustration of FIG. 3, it may be appreciated that the sequence of events as just described for the $j^{th}$ channel also takes place simultaneously for all J-channels. On the right hand side of FIG. 3 it is shown that the J-values of $C_j$ are simultaneously transferred out of the J-channels into a single vertical shift register where they are sequentially shifted downward to form the ultimate output signal.

By iterating through the preceding sequence of events one more time, it is seen that at time $t_{N+1}$ the values transferred out of the J horizontal shift registers have the form $$C_j = \sum_{n=1}^{N} g_{jn} f_{n+1}$$

More generally, at the time $t_{N+m}$, they have the form $$C_{j,m} = \sum_{n=1}^{N} g_{jn} f_{n+m}$$

Note that this is of the desired form of equation (2).

In effect, this device is performing a "sliding-window correlation" in that it is correlating N-samples of the input with the reference library and then "sliding" this "window" along the input signal to obtain correlation values for all possible registrations between the reference and input signals.

For simplicity the preceding explanation assumed that the input signal modulating the light source is a discrete time sample signal $f_t$ and that the charge coupled device timing pulses were synchronized to occur between the input samples. The input signal may, however, be a continuous analog waveform and it can be shown that the charge coupled device array itself performs the sampling operation.

The continuous analog input signal as illustrated in FIG. 4*a* will cause the intensity of the optical energy illuminating the charge coupled device array to have a continuous time variation, as illustrated by FIG. 4*b*. The discrete photo responsive elements of the charge coupled device array operate to integrate the total light intensity which illuminates the surface of each photo responsive element during some integration time T as determined by the length of the timing pulses provided by the clock in the manner graphically illustrated by the waveform of FIG. 4*c*. The photo responsivity of the charge coupled device is represented by the waveform of FIG. 4*d* and resultant shifted charges are shown by FIG. 4*e*.

Thus, the sequence of charges which the charge coupled device array photo responsive elements adds to each channel is a discrete analog time-sampled version of the input signal with each sample being the integration of the input signal for a period T.

It is assumed that the timing pulses provided by the clock have a frequency $f_h$, then the input signal is sampled at the frequency of $f_h$; therefore, by the Shannon sampling theorem, the input signal can contain frequencies no higher than $f_h/2$ with loss of some information. Thus, $f_{input} \leq f_h/2$.

It should also be noted that the horizontal shifting of charges should also have the frequency $f_h$ and should occur immediately after the clocking pulses. Therefore the output values $C_j$ should emerge from the horizontally disposed channels also at a frequency of $f_h$.

As may be seen from FIG. 3 the vertically operative shift register must operate at a frequency $f_v$ which is at least greater than $f_h$ by a factor J in order that all J values or $C_j$ are read out before the next J values of $C_j$ are shifted from the horizontal channels. Thus $$f_v \geq Jf_h$$

With typical values of $f_v = 4$ MHz and $J = 100$, then $f_H$=40KHz and $f_{input}$=20 KHz. Thus this mode is limited to audio frequencies. (Although the output coefficient rate is $4 \times 10^6$ analog values per second).

There is a second mode of operation of this device, called the adjacent window mode for applications where the sliding window mode is not appropriate. To achieve this second mode of operation it is necessary that in future charge coupled devices designed for this type of processing a "leakage tap" must be inserted between the outputs of the horizontal registers and the vertical register such that, upon application of a predetermined voltage to this lead, the charges extruding from the horizontal registers will be prevented from entering the vertical register by being diverted along this leakage path. With reference to equation (2), all correlation values for $m = 1$ to $N-1$ (more generally from $m = kN+1$ to $(k+1)N-1$, $k = 0, 1, 2, 3, 4, \ldots$) may then be discarded along this leakage tap so that only the values for $m = kN$ are allowed to enter the vertical register and be outputted. The net effect of this is that the device is now correlating the reference library with adjacent windows of the input signal.

For the case of $J=N$ (i.e., a square array), the vertical shift register need now only operate at a frequency $$f_v = f_H$$

in order to allow the J-correlation coefficients pertaining to one window of the input signal to be read out before the coefficients pertaining to the adjacent window are ready to enter the vertical register. Using the same typical operational values used above, the highest input frequency is now limited only to 2 MHz.

Those skilled and knowledgeable in the optical processing arts will appreciate that the system of the present invention provides many advantages by the utilization of a two-dimensional charge coupled device array to perform not only integration and optical readout functions but also the scanning or sweep operation which in prior art systems was previously performed by an oscillating or revolving mirror. This is a most important aspect, feature, and advantage of the concept of the present invention because it (1) employs a wholly solid state device in the place of the only mechanical moving part of comparable prior art systems such as the U.S. patent referenced hereinbefore (2) eliminates the need for an optical imaging system (3) significantly increases the speed and dynamic range of the system, and (4) reduces the size, weight, and complexity of the overall system.

Obviously many modifications and variations of the present invention are possible in the light of the above teachings. It is therefore to be understood that within the scope of the appended claims the invention may be practiced otherwise than as specifically described.

What is claimed is:

1. A multi-channel optical correlation system comprising:

a mask having a plurality of linearly disposed channels, each said channel having known recorded information defined by variations in opacity along its linear length;

a light source positioned to illuminate said mask;

means for modulating the intensity of said light source as a function of an input signal;

a multiple element, photo-responsive charge coupled device positioned to receive the light energy transmitted by the illuminated mask and having elements arrayed in linearly disposed groups along axes parallel to said linearly disposed channels for developing a charge within each said element commensurate with the photo energy received at its position;

a source of clock signals; and means applying said clock signals to said charge coupled device for cumulatively shifting charges developed within each said linearly disposed group and generating a cumulative charge output for each said group indicative of its degree of correlation to said input signal.

2. A multi-channel optical correlation system as claimed in claim 1 wherein said mask comprises photographically recorded information.

3. A multi-channel optical correlation system as claimed in claim 1 wherein said light source emits noncoherent light.

4. A multi-channel optical correlation system as claimed in claim 1 wherein said light source comprises a light emitting diode.

5. A multi-channel optical correlation system as claimed in claim 1 wherein said clock signals have the same cyclic period as iterative samplings of said input signal.

* * * * *